United States Patent [19]

Haenni et al.

[11] 4,063,445

[45] Dec. 20, 1977

[54] BENDING PRESS

[75] Inventors: Eduard A. Haenni, Zofingen; Vaclav Zbornik, Oftringen; Walter Gygli, Niederbipp, all of Switzerland

[73] Assignee: Haemmerle AG Maschinenfabrik, Zofingen, Switzerland

[21] Appl. No.: 771,746

[22] Filed: Feb. 24, 1977

[30] Foreign Application Priority Data

Apr. 3, 1976 Austria ..... 2405/76

[51] Int. Cl.[2] ..... B21D 5/01

[52] U.S. Cl. ..... 72/465; 72/389; 267/119

[58] Field of Search ..... 72/389, 465, 382; 267/119, 130

[56] References Cited

U.S. PATENT DOCUMENTS 4,014,204 3/1977 Hanni et al. ..... 72/465

*Primary Examiner*—Lowell A. Larson

[57] ABSTRACT

A machine for processing metal in sheet or plate form, especially for bending metal sheets. The machine comprises a frame with a table base on the frame and a ram which is vertically displaceable in relation to the table base. The ram has an upper tool, while a lower tool is disposed on the table base, these two tools cooperating to process the metal therebetween. The lower tool is elastically supported on the table base by means of a plurality of individual resilient supports which are arranged in a row on the table base. A plurality of intermediate parts are inserted between the table base and the supports and said parts are displaceable groupwise out of the effective region of selected supports into a neutral position, so that only the supports lying directly under the metal sheet workpiece to be processed are effective.

9 Claims, 4 Drawing Figures

P1
P2
B

BENDING PRESS

BACKGROUND OF THE INVENTION a. Field of the Invention

The present invention relates to a bending press of the kind having a worktable and a lower and upper tool and sometimes known as a "press brake". More particularly the invention relates to a bending press of this kind in which the lower tool is supported in an elastically resilient manner.

b. The Description of the Prior Art

The present applicants have already proposed using an elastic substrate or an oil cushion for the support, and in this connection we have put forward specific proposals as to how the accuracy of the working operation of the press can be improved. More particularly, provision is made for compensating automatically for any deformation of those elements of the bending press which participate primarily in the pressing operation. One proposal, for this purpose, provides for the use of a worktable having a table plate which rests on a supporting element which corresponds to the length of the table plate and which is mounted so as to be vertically displaceable in a base part so as to rest on an oil cushion. If the workpiece to be processed is shorter than the available length of the worktable, then the workpiece is too severely pressed at the ends and inaccuracies arise at the ends. More precise workpiece processing is possible with a bending press in which the tool itself, which is supported in an elastically-resilient manner, or its support, is formed from a number of sections which are arranged side-by-side so as to be vertically displaceable independently of one another, in such a way that, under load, only those sections on which the workpiece rests directly or indirectly are shifted against the action of the elastic substrate. Examples of these prior art proposals are found in U.S. Pat. No. 4,014,204.

OBJECT OF THE INVENTION

An object of the invention is to propose a further improvement to those bending presses in which the supporting of the tool with the aid of the above sections is not possible.

SUMMARY OF THE INVENTION

With this above object in view, the present invention provides a bending press having a worktable as well as an upper tool and a lower tool which bends the sheet metal therebetween. The lower tool is supported in an elastically resilient manner, by means of a row or series of resilient individual support parts on the worktable. A plurality of intermediate parts are each inserted between the table and each support part. The intermediate parts are each made displaceable by means of at least one common actuating member so as to move out of the effective region of selected supports in groups and into a neutral position in which the supports are ineffective.

BRIEF DESCRIPTION OF THE DRAWINGS

A preferred embodiment of the press of the invention is illustrated schematically in the accompanying drawings, in which.

DESCRIPTION OF A PREFERRED EMBODIMENT

Figures 1, 2, 3, 4:
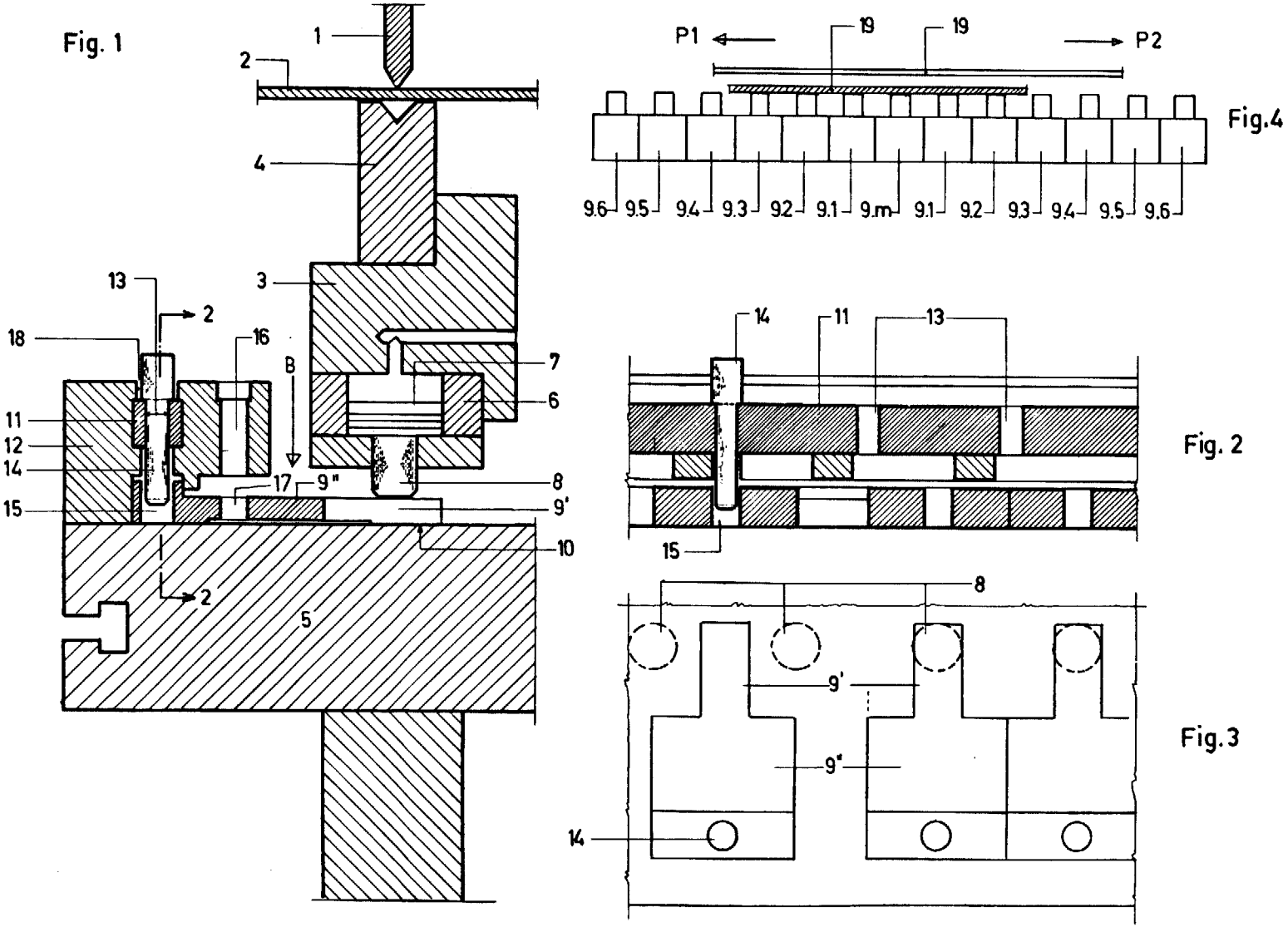
FIG. 1 is a cross-sectional side elevation of the preferred embodiment of the bending press with only those parts which are material to the invention being shown.
FIG. 2 is a sectional elevation taken as indicated by the line 2—2 of FIG. 1.
FIG. 3 is a fragmentary plan view taken as indicated by the arrow B in FIG. 1.
FIG. 4 is a basic diagram illustrating the principles of operation of the press.

Referring to FIG. 1, the illustrated bending press commonly referred to as a press brake, comprises an upper tool 1 and lower tool 4 by means of which a workpiece 2 is processed. The press has a matrix holder 3 in which the lower tool 4 is accommodated. The matrix holder 3 is supported in an elastically resilient manner on the worktable 5. For this purpose of resilient support, there is arranged in the matrix holder 3, a number of cylinders 6 which are directed towards the worktable 5 and are arranged side by side in the longitudinal direction of the matrix holder 3. Disposed in each cylinder 6 is a corresponding piston 7 having a respective piston rod 8 which extends downwards and projects out of its cylinder 6 in the fashion shown in FIG. 1.

Further there is arranged on the table 5, a plurality of intermediate parts each comprising respective parts 9' and 9''. These parts are referred to by the reference numeral 9 for convenience. These parts 9 are designed as flat T-shaped slide components. The longitudinal beam of each leg 9' of each intermediate part 9 lies underneath a respective piston rod 8, while the transverse beam or cross bar 9'' lies outside of the effective region of the respective piston rod 8. The intermediate parts 9 rest at their under-surfaces 10 on the top surface of the worktable 5 and may be displaced in a parallel direction relative to the longitudinal direction of the press, i.e. perpendicularly to the plane of FIG. 1. The arrangement of the intermediate parts 9 is such that their transverse beams or cross bars 9'' form a straight line and the end surfaces of each adjacent pair of the beams or cross bars 9'' can thereby be in contact with one another.

In order to provide for displacing the intermediate parts 9 there is mounted at least one sliding bar 11 in guide 12 so as to be displaceable in said guide 12 which is attached to the worktable 5 and extends along the intermediate flat slide 9. Preferably there are two of those sliding bars 11, axially aligned, and the one sliding bar 11 extends from the one end of the press as far as the center of the press, while the other bar 11 extends from the center of the press as far as the other end. In order to move the bars 11 there are provided actuating members which are not shown in detail in the drawings and may take any convenient and practical form. These members may be actuated by hydraulic, pneumatic or electrical elements which are conventional. Each sliding bar 11 is provided with a number of transverse bores 13 into which an entrainment pin 14 can be inserted selectively. The pin 14 engages through a corresponding oval bore 18 of the attachment 12 and extends by its bottom end into a bore 15 of the corresponding intermediate part 9. Further corresponding bores in the attachment 12 and the intermediate part 9 are designated respectively by the numerals 16, 17. These corresponding bores 16, 17 extend parallel to the bores 15 and 18, but do not touch or affect the sliding bar 11. In the position shown in FIG. 1, one entrainment pin 14 is positioned in a bore of the sliding bar 11 and extends into the bore 15 lying therebelow, of the intermediate part 9. Accordingly, if the sliding bar 11 moves, this causes movement both of the directly engaged intermediate part 9 and also of the other intermediate parts 9 arranged side-by-side, in such a way that the respective longitudinal beams or legs 9', of the displaced intermediate parts 9 pass out of the region of the respective piston rods 8. When the entrainment pin 14 is transferred into the bores 16 and 17, then the connection between the sliding bar 11 and the intermediate parts 9 is interrupted, so that the sliding bar 11 can be moved freely without moving the parts 9. As has already been mentioned, the movement stroke of the sliding bar 11 is so dimensioned that in the one end position of the bar the longitudinal beam or leg 9' of the intermediate part 9 passes out of the region of the respective piston rod 8 and upon reverse motion these longitudinal beams or legs 9' again come to rest exactly under the respective piston rods 8. Since the attachment 12 is connected securely to the worktable 5 and does not take part in the movement of the sliding bars 11 nor of the entrainment pin 14, it is necessary to make the bores 18 in the attachment 12 oval in their configuration, so that the length of the oval corresponds to the length of stroke of the sliding bars 11.

With the above described preferred embodiment of the bending press, the result is achieved that only those intermediate parts 9 which lie underneath the workpiece to be processed will remain under the relevant piston rod 8. The central intermediate part 9 (FIG. 4) does not need to be displaced out of the region of the pertinent piston rod 8 and can be arranged in a fixed manner, since upon each operation the workpiece 2 to be processed is introduced in the center of the press. Thus, if only a short workpiece 19, which extends for example to the right and to the left over respectively two intermediate parts 9.1, 9.2 (see FIG. 4) is to be processed, then the remaining intermediate parts 9.3 to 9.6 should be pushed away in the respective opposite directions as indicated at P1 and P2 of FIG. 4 so that only the five central sliding intermediate parts 9.2, 9.1, 9.m, 9.1, 9.2, remain in their effective positions. To remove these sliding parts 9.3 to 9.6 the respective entrainment pins 14 are inserted into the respective bores 15 of each of the sliding parts 9.3 and the two sliding bars 11 are shifted respectively to the right and to the left. Upon subsequent operation of the press, only the piston rods 8 of the central piston 6 and of the two piston 6 present to the right and left thereof encounter resistance, while the remaining piston rods 8 can move freely downwards.

If a longer workpiece 20 which extends to the right and left, for example over the intermediate parts 9.1 to 9.4, is to be processed then the sliding bars 11 are connected to the intermediate parts 9.5, which is effected by simple repositioning of the entrainment pins 14. The sliding bars 11 will displace the intermediate parts 9.5 in the directions of the respective arrows P1 and P2, whereby the remaining sliding parts 9.6, 9.7 and 9.8 are correspondingly moved. Upon the following pressing operation, only those piston rods 8 which lie under the workpiece to be processed are supported by intermediate parts 9, while the remaining piston rods 8 can run out without resistance.

For automation of specific work cycles which are to be repeated, the positioning of the entrainment pins can be arranged to be effected automatically by programmed control means using known techniques. The return of the intermediate parts 9 into their initial positions is effected by analogous repositioning of the two entrainment pins 14 in the bores 18, 13, 15 of the two outer sliding parts 9.8 and moving of the sliding bars 11 in directions opposed to the directions of the arrows P1 and P2.

What we claim is:

1. A machine for processing metal in sheet or plate form, especially for bending metal sheets, comprising:

a machine frame, a table base on said frame, a ram vertically displaceable in relation to said table base, an upper tool mounted on said ram, a lower tool disposed on said table base, said upper and said lower tools cooperating for processing said metal sheet therebetween, elastically-resilient supporting means for supporting said lower tool on said table base, said supporting means consisting of a plurality of individual, resilient supports arranged in a row or series on said table base, a plurality of intermediate parts inserted between said table base and said plurality of individual supports, said intermediate part being displaceable out of the effective region of selected supports in groups and into a neutral position in which said selected supports are ineffective, and an actuating member for the common displacement of said groups of intermediate parts into said ineffective neutral position.

2. A machine according to claim 1, in which there is provided a matrix holder, serving for the reception of the lower tool, said matrix holder having arranged therein a number of cylinders which are directed towards the worktable and are arranged side-by-side in the longitudinal direction of the matrix holder, there being, in each cylinder, a piston with a respective piston rod which extends out of the cylinder downwards towards the worktable.

3. A machine according to claim 1, in which the intermediate parts are designed as flat T-shaped sliding parts and are so arranged side-by-side that the transverse beams or cross bars of the T-pieces lie in a straight line with the end surfaces of the adjacent transverse beams or cross bars contiguous.

4. A machine according to claim 1, in which the actuating member extends along the sliding parts and is in the form of a one-part or two-part sliding bar mounted so as to be displaceable in a guide attached to the worktable.

5. A machine according to claim 4, in which each sliding bar is provided with transverse bores which correspond with corresponding bores in the guide or in the intermediate parts, and in which for connecting the sliding rod to one of the intermediate parts, entrainment pins are inserted in the bores.

6. A machine according to claim 4, in which the guide is equipped with a further row of bores lying outside the sliding bar, each bore of this row corresponding with a corresponding bore of the sliding part lying therebelow, so that upon transfer of the entrainment pin into the bores of the further row the connection between the sliding bar and the sliding part is interrupted.

7. A machine according to claim 4, wherein two of said sliding bars are arranged in axial alignment and are movable in opposite directions, the one sliding bar extending from the one end of the press as far as the centre of the same and the other bar extending from the centre as far as the other end of the press.

8. A machine according to claim 4, in which the movement stroke of the sliding bar is so dimensioned that in the one end position of the bar the longitudinal beam or leg of each of the sliding parts passed out of the range of the respective piston rod and in the other end position the longitudinal beams or legs are disposed under the respective piston rods.

9. A machine according to claim 4, in which the bore in the attachment is oval in configuration, the length of the oval corresponding to the length of stroke of the sliding bar.

* * * * *